United States Patent [19]

Lerner

[11] 4,337,058

[45] Jun. 29, 1982

[54] METHOD OF MAKING A CONTAINER STRIP HAVING INSERTS

[75] Inventor: Bernard Lerner, Peninsula, Ohio

[73] Assignee: Automated Packaging Systems, Inc., Twinsburg, Ohio

[21] Appl. No.: 151,320

[22] Filed: May 19, 1980

Related U.S. Application Data

[63] Continuation of Ser. No. 901,997, May 1, 1979, abandoned.

[51] Int. Cl.[3] ..... B31B 23/74

[52] U.S. Cl. ..... 493/11; 493/198; 493/210; 493/238

[58] Field of Search ..... 493/193–197, 493/224, 223, 215, 214, 222, 216, 198, 233, 230, 238, 926, 11, 6, 221, 210; 156/519; 53/51

[56] References Cited

U.S. PATENT DOCUMENTS

| | | | |
|---|---|---|---|
| 1,424,356 | 8/1922 | Healy | 229/71 X |
| 2,898,026 | 8/1959 | Aid | 229/41 B X |
| 2,995,174 | 8/1961 | Wang | 156/519 |
| 2,999,533 | 9/1961 | Slagel et al. | 493/198 X |
| 3,148,598 | 9/1964 | Davis | 493/203 X |
| 3,332,324 | 7/1967 | Lehmacher et al. | 493/224 X |
| 3,552,278 | 1/1971 | Guenther | 493/198 X |
| 3,743,567 | 7/1973 | Abler | 493/198 X |
| 3,762,628 | 10/1973 | Sargent | 229/56 |
| 3,850,724 | 11/1974 | Lehmacher | 493/203 X |
| 4,041,846 | 8/1977 | Lerner | 493/198 X |

*Primary Examiner*—James F. Coan

*Attorney, Agent, or Firm*—Watts, Hoffmann, Fisher & Heinke Co.

[57] ABSTRACT

A method of forming a container strip of flexible sheet material having anti-corrosion inserts is disclosed. The method includes the steps of bringing two webs of flexible material into superimposed relationship, applying an adhesive to one of the webs, and feeding inserts, one by one, between the two webs. Thereafter, the webs are passed between rolls which compress the webs and the inserts to adhere the inserts to the web having adhesive. Edge seals, end seals, and perforations then are formed to produce a strip of flexible containers suitable for reception of corrosion prone articles.

In an alternative embodiment, an adhesive is applied to both webs at spaced locations and an insert then is compressed between the webs at a location toward one end of the container. This technique produces a container having a header portion to provide support for display purposes.

5 Claims, 7 Drawing Figures

METHOD OF MAKING A CONTAINER STRIP HAVING INSERTS

This is a continuation, of application Ser. No. 901,997 filed May 1, 1979, and now abandoned.

REFERENCE TO PATENTS AND APPLICATION

1. U.S. Pat. No. 3,254,468, issued June 7, 1966 to Hershey Lerner, entitled Method of Packaging Articles, here the "Airbox Patent."

2. U.S. Pat. No. 3,254,828, issued June 7, 1966 to Hershey Lerner, entitled Flexible Container Strips, here the "Container Patent."

3. U.S. Pat. No. 3,815,318, issued June 11, 1974 to Bernard Lerner, entitled Packaging Method and Apparatus, here the "Single-Gripper Patent."

4. U.S. Pat. No. 2,521,311, issued Sept. 5, 1950 to Edward J. Schwoegler et al, entitled Corrosion Inhibiting Compositions, here the "First Anti-Corrosion Patent."

5. U.S. Pat. No. 2,534,201, issued Dec. 17, 1950 to Clemens A. Hutter, entitled Carton Having Metal Corrosion Inhibiting Characteristics, here the "Second Anti-Corrosion Patent."

6. Ser. No. 901,996, filed concurrently by Bernard Lerner, entitled Container Strip Having Inserts.

BACKGROUND OF THE INVENTION

1. Field of the Invention

The invention relates to forming containers from flexible sheet material and, more particularly, to a method for forming such containers having inserts which have an effect on contents which may be disposed in a container and/or stiffen the container for display purposes.

2. Description of the Prior Art

A continuing problem in the packaging industry relates to forming containers from flexible sheet or film material containing elements or materials for affecting the product being packaged in a desired fashion and/or for enhancing the structural integrity of the final package.

One example of this kind of packaging problem occurs in the production of flexible container strips having inserted elements or materials for extending the shelf life of the packaged products. Although products susceptible to deterioration can be sealed inside containers under a vacuum or can be coated to resist deterioration prior to being placed in the container, it is apparent that these approaches involve a certain expenditure of time and effort and thus complicate packaging.

One approach, used for garment storage, was to construct a garment storage bag in which a fumigant could be disposed along with the garments. In one proposed garment bag, a foraminous pocket for holding a supply of moth repellant or insecticide was mounted within the bag; in another garment bag, a plurality of small containers filled with fumigant were attached to a board-like strip which, in turn, was affixed to a carrying frame within the bag. It is clear that these approaches were not effective for high-speed production, rough handling, or any number of other demands imposed upon modern containers.

Although insert materials suitable for acting on container contents in a desired manner already are known, present-day techniques for placing products into the containers along with the inserts do not lend themselves well to high-speed, efficient packaging. One proposal involved the use of container inserts impregnated with suitable materials such as corrosion-inhibitors, fumigants, etc. which could be inserted in the containers along with the products being packaged. A suitable anti-corrosion composition is disclosed by the Anti-Corrosion Patents referred to above. Another technique provided for attaching frangible ampules containing color-sensitive chemicals to a card and thereafter placing the card inside a container along with products to be sterilized. After the container and contents were sterilized and sealed, the ampules could be broken and the resultant color change (or lack of color change) indicated whether the contents were sterile. These approaches did not lend themselves well to high-speed production because the inserts tended to interfere with loading the products in the containers.

A concern in the packaging industry relates to displaying packaged products for public consumption in an appealing manner. Plastic bag-like packages of the character referred to are frequently constructed from transparent plastic film through which packaged products can be observed. When inserts of the character referred to above are mixed in with the products in such packages they can be seen by potential purchasers and they tend to reduce the appeal of the packages.

Another type of package insert element which has been used in the past is an advertizing sheet, or label, placed in the container with the products to identify the products, the manufacturer etc. These inserts, like those referred to previously, have made it difficult to achieve high rate packaging even though they may not be unsightly themselves. By printing labelling information on the container film itself, the production problems attendant loading packages with label inserts have been avoided in some circumstances.

The alternative practices of printing labels on the container film and inserting labels with the packaged product have not been effective to improve the appearance of packages of the sort referred to which are suspended from display racks, support hooks and so forth. Although these packages can be suspended from display racks simply by punching a hole through them, this type of approach tends to be undesirable because the package lacks structural strength. If the packaged products are relatively heavy the film packaging material tends to sag so that the labelling is obscured and the package appearance is poor. This approach is not even usable if it is desired to maintain a particular atmosphere within the container, that is, if a seal must be maintained for some reason.

In order to provide more readily supportable packages proposals have been made to divide the container into separate sections—one section for the container contents, and one section identified as a so-called header which can be punctured or to which external advertising or labeling material can be affixed for reinforcement. This construction permits the container contents to be isolated at all times and yet the header portion of the bag is stiff enough to permit the package to be suspended from a display rack.

Although the foregoing approach generally is effective, several improvements still are possible. For example, the external advertising material must be stapled or glued to the outside of the header and this presents problems vis-a-vis production speed and the security of the attachment. Among other things, stress concentrations can be developed if the attachment is not secure enough and the container may be ruined during handling or loading onto the display rack. Also, the external advertising material tends to increase the bulk of the finished container so that handling difficulties are increased and more space is required to display a given quantity of containers than otherwise is desired.

These problems may be overcome if the materials added to the header portion are disposed inside the header portion rather than being fastened to the outside of the header portion. Unfortunately, it is very difficult to process a container rapidly while at the same time placing an insert inside the header portion of the container.

SUMMARY OF THE INVENTION

The present invention provides a high-speed, low-cost technique for forming a container strip having inserted element or material included with the strip. The inserts are included with the strip in such a manner that production speed of the strip is not adversely affected. In one embodiment, the inserts are carried by a container portion of the strip and are so constituted that container contents may be acted on favorably. In another embodiment, inserts are disposed toward one end of the container to serve as a header portion which stiffens the container.

Essentially, the method according to the invention comprises bringing web portions into superimposed relationship and placing sheet-like inserts between the web portions at predetermined intervals along the length of the web portions. The inserts are adhered to one of the web portions so that the inserts are fixed in place during further processing. An insert is disposed between the ends of each container in the strip. By this technique, containers are formed with inserts already in place so that products can be loaded into each container without interference from the insert, additional handling and loading steps are avoided and a more easily handled and displayed package is assured.

Where the insert is to be placed inside a header portion of the container, the insert can be fed between first and second webs employed to form the container. The first and second webs can be sealed together around the periphery and at an intermediate location to define a header in which the insert is retained in place.

If additional stiffness is required, the insert can be adhered to the first web, the second web, or both. An especially favorable technique for doing this involves applying adhesive to both of the web portions at spaced intervals, preferably in a plurality of narrow strips extending longitudinally of the container. By this construction, externally disposed material no longer is needed to stiffen the header and adequate stiffness is provided with considerable decrease in bulk.

Additional advantageous features of the invention will become apparent from the following detailed description of the preferred embodiment of the invention made with reference to the accompanying drawings which form a part of the specification.

DESCRIPTION OF THE PREFERRED EMBODIMENT

Figure 3:
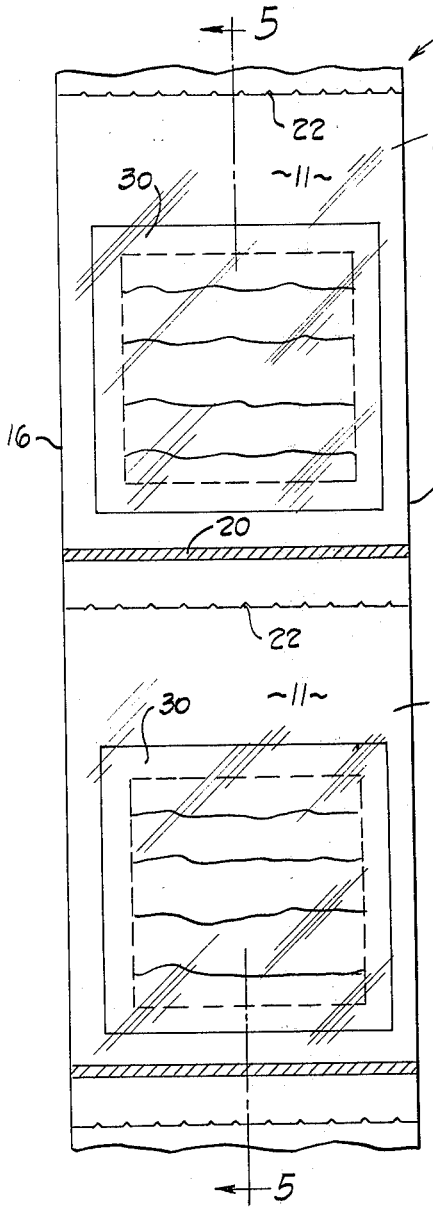
FIGS. 3–5 show a finished container produced according to the invention.
Figure 4:
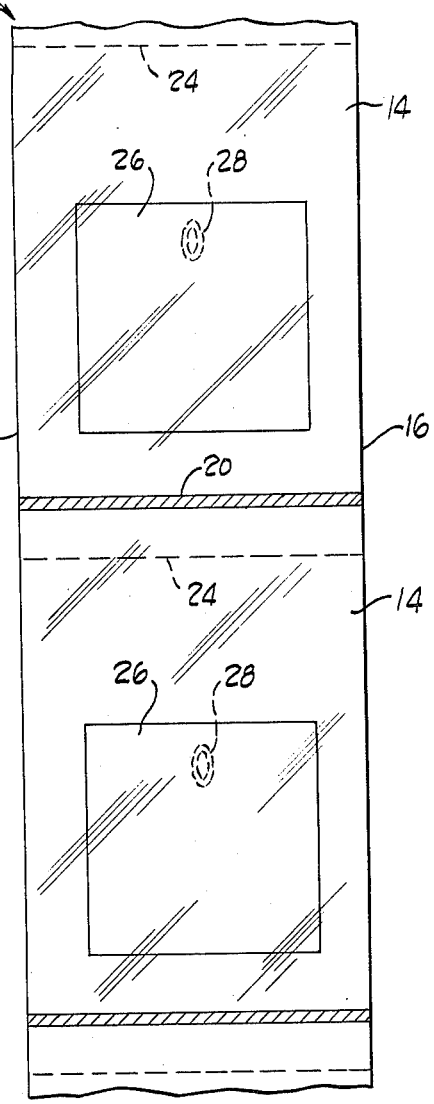
Figure 5:
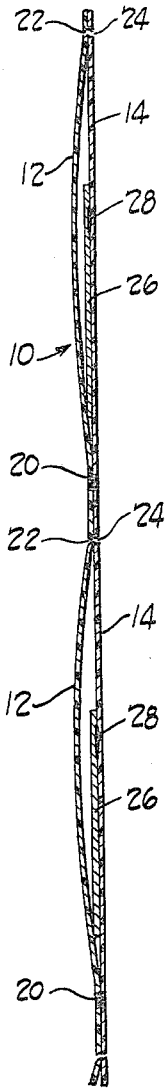

Referring to the drawings and to FIGS. 3–5 in particular, a container strip produced by the process of the present invention is indicated by the reference numeral 10. The container strip includes a plurality of identical, interconnected containers 11 which are formed from a flexible, heat-sealable sheet material such as polyethylene, polypropylene, cellophane, and the like. The Airbox Patent and the Single Gripper Patent illustrate a similar container strip and disclose different uses to which those containers may be put. Those prior containers have been manufactured and sold by Automated Packaging Systems, Inc. under the registered trademark AUTOBAG.

The container strip 10 is formed by a first, overlying ply or web or portion 12 and a second, underlying ply or web portion 14. The webs 12, 14 are joined together along their sides 16, 18 so that a tube-like structure is created. In order to form the individual containers 11 as part of the strip, a plurality of spaced, heat-sealed portions 20 are formed along the strip at regular intervals. The seals 20 extend transversely of the strip and completely across the strip to include the sides 16, 18. In order to complete the containers, perforated lines 22, 24 extend completely across webs 12, 14, respectively, and provide a line of weakness in the container strip for separation of the containers.

Each container 11 contains a sheet-like insert 26. The insert 26 is adhered to the web 14 along that portion of the insert disposed closest to the perforated lines 22, 24 by a drop of hot melt glue 28. In this manner, the insert forms a part of an inner surface of a product-containing volume of the container. Accordingly, when the container eventually is inflated by an airblast or otherwise, the insert 26 will be held closely to the web portion 14 and the insert will not interfere with any product being loaded into the container. Also, and perhaps more fundamentally, the insert cannot be blown out of the container by the airblast that inflates the container. Inserts having different properties already are known and reference is made to the Anti-Corrosion Patents and to the co-pending application referred to above for more information in this regard.

Advertising for the container contents or other information may be provided by the inserts themselves or by an opaque portion 30 included as part of one of the webs 12, 14. As shown in FIG. 3, the opaque portion includes indicia describing the container contents, the manufacturer, and so forth. In order to enhance the appearance of the container when an opaque portion is provided, the insert 26 is slightly smaller than the opaque portion and is positioned within the container in registry with the opaque portion so that the insert is not visible from the front.

Figure 1:
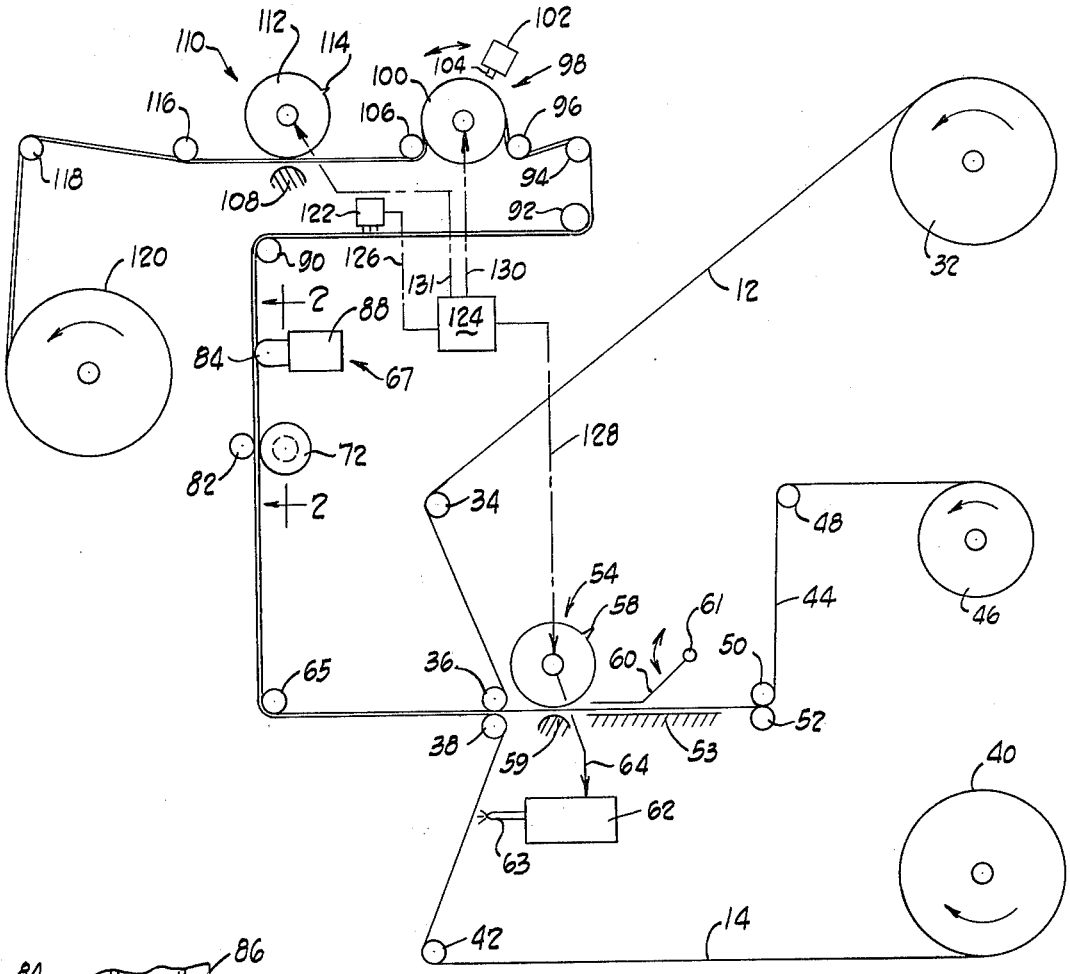
FIG. 1 is a schematic representation of apparatus suitable for carrying out the invention.

Apparatus suitable for carrying out the process according to the invention is shown schematically in FIG. 1. The first web portion 12 is fed from a supply roll 32. The web portion 12 passes over a tensioning roll 34 and thence to a pair of nip rolls 36, 38. In a similar manner, the second web portion 14 is fed from a supply roll 40 around a tensioning roll 42 to the nip rolls 36, 38.

In order to provide the inserts 26 for the containers 11 which are to be formed, a paper web 44 is passed from a supply roll 46 around a tensioning roll 48 and thence through a pair of rolls 50, 52. The rolls 50, 52 are driven by a variable speed mechanism (not shown) which permits the paper web 44 to be fed at any desired speed.

The paper web 44 passes across a supporting surface 53 and thence beneath a cutter roll 54 comprised of a cylindrical body 56 having a knife 58 extending from one edge to the other. An anvil 59 is spaced from the cutter roll so that only the knife and not the cylindrical body will contact the anvil and, hence, the paper web. By rotating the roll 54 in conjunction with passing the paper web 44 through the rolls 50, 52, the paper web will be chopped into individual sheet-like pieces. Because the paper web is being pushed by the rolls 50, 52, it may tend to buckle and thus a finger 60 is provided to compress the web against the supporting surface 53. The finger is pivotally mounted as at 61 so that the finger will ride over the web under the influence of gravity.

The webs 12, 14 are brought together at the nip rolls 36, 38, and the leading edge of the paper web 44 is fed between the nip rolls. The speed of the rolls 50, 52 is coordinated with the speed of the nip rolls 36, 38 to provide inserts of a desired length, although the rolls 50, 52 always are rotated slower than the rolls 36, 38. The webs 12, 14 frictionally engage the leading edge of the paper web and tend to drag the paper web through the nip rolls because of the difference in speed of the two sets of rolls. The drag from the nip rolls is low enough that the paper web is kept taut without ripping the paper web and, accordingly, the paper web is positioned over the anvil 59 for smooth severance by the knife 58. After severance, the now-formed insert accelerates to the speed of the webs 12, 14 and the severed edge of the paper web, because the paper web continually is being advanced by the rolls 50, 52, is advanced between the nip rolls to repeat the cycle.

The inserts are secured to one of the web portions by an adhesive. This is accomplished expeditiously by a glue applicator 62 which deposits drops of hot-melt glue 28 onto the web 14 through a nozzle 63. The application of the glue is coordinated with rotation of the cutter roll 54 (by a timing mechanism indicated at 64) so that each drop of glue 28 arrives at the nip rolls shortly after the leading edge of an insert. Because the web is moving with respect to the insert until the insert is severed, the drop of glue is smeared longitudinally of the insert until the knife 58 cuts the paper web. Thereafter, by passing the web portions and the inserts through the nip rolls, each insert is compressed between the web portions and is adhered firmly to the web portion 14 so that it is secured in place. Thus, inserts are secured to the web.

Figure 2:
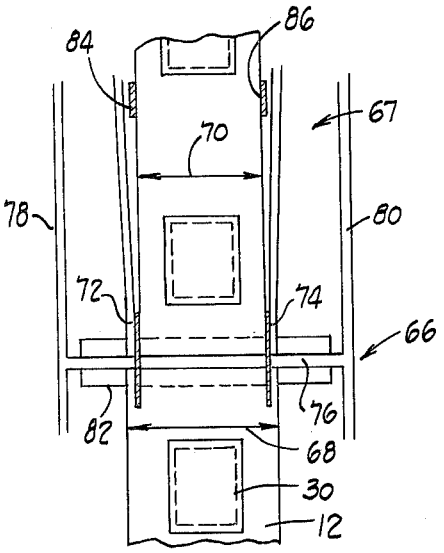
FIG. 2 is a view taken along line 2—2 of FIG. 1 showing how the web portions are trimmed and sealed at their edges.

After the web portions 12, 14 and the individual inserts have passed between the nip rolls 36, 38, the now-superimposed web portions are passed over a tensioning roll 65 and then past an edge trimmer 66 and an edge sealer 67. Referring now to FIG. 2, the edge trimmer trims excess material from each side of the superimposed web portions and smooths the edges of the webs for resultant sealing. The width of the strip is reduced from that indicated by the arrow 68 to that indicated by the arrow 70. The trimming is accomplished by a pair of spaced, sharpened disks 72, 74, which are supported for rotation by a roll 76 which itself is carried by a pair of spaced frame members 78, 80. A roller 82 having a plurality of circumferential grooves also is carried by the frame members 78, 80 and is positioned such that the disks 72, 74 run in certain of the grooves. By this construction, web portions passing between the rolls 76, 82 are slit to produce a container strip of a desired width. By moving the disks 72, 74 toward or away from each other, the disks will run in other circumferential grooves in the roller 82 and a narrower or wider strip can be produced.

The edge sealer 67 includes resistive heating elements 84, 86 disposed on either side of the container strip and spaced at that width indicated by the arrow 70. The edge sealer 67 also includes a carrier 88 which supports the heating elements 84, 86 for movement toward and away from the container strip. The elements 84, 86 are heated to a temperature sufficient to melt the material forming the container strip so that by placing the heating elements adjacent the edge of the container strip, an edge seal is formed. Because the superimposed plys 12, 14 already have been trimmed smoothly at their edges, the resultant heat seal produced by the elements 84, 86 is secure and leak-free.

After the container strip has been trimmed and sealed at its edges, the strip passes over tensioning rolls 90, 92, 94 and 96 and then transverses an end sealer 98. The end sealer 98 includes a relatively soft roll 100 about which the strip is tightly wrapped; the sealer 98 also includes a shuttle 102 having a heated resistive element 104 extending from one side of the roll 100 to the other. By bringing the element 104 into contact with the roll 100 during a portion of the rotation of the roll, a transverse heat seal 20 may be provided for the strip. The timing of the engagement of the element 104 with the strip is chosen so that proper end seal spacings will be provided.

After the end seals have been formed, the strip passes over a tensioning roll 106 where it then passes between an anvil 108 and a perforating roll 110. The perforating roll includes a cylindrical body portion 112 having a toothed knife 114 extending from one edge of the roll to the other. The knife punctures the superimposed webs 12, 14 at spaced locations to provide the perforated lines 22, 24 extending from one edge of the container strip to the others.

After the perforated lines 22, 24 have been formed by the roll 110, the now-completed container strip passes over tensioning rolls 116, 118 and then is wrapped on a takeup roll 120. Subsequent uses of the container strip may be as described in the referenced patents and the co-pending application.

A timing mechanism is provided to coordinate the motion of the various components of the system so that the seals, perforations, opaque portions, inserts, and drops of glue are spaced properly with respect to each other. The control of the glue applicator 62 already has been stated to be in response to rotation of the cutter roll 54. The other components are controlled in part by a sensor 122 located intermediate the rolls 90, 92. The sensor is responsive to timing marks imprinted on the web 12 at regular intervals, the intervals being equal to the desired length of each container.

When the sensor detects the pressence of a particular mark, a signal is sent to a junction box 124 via a line 126. The junction box in turn sends a signal to differential speed controls (not shown) associated with the cutter rolls 54, the end sealer 98, and the perforation roll 110 via lines 128, 130, and 131, respectively. By this technique, each timing mark provides an input to the junction box which may cause the speed controls to speed up or slow down the controlled rolls. Therefore, any stretching or contraction of the webs can be accounted for and cumulative error from timing mark to timing mark can be corrected before the error is noticable.

Figure 6:
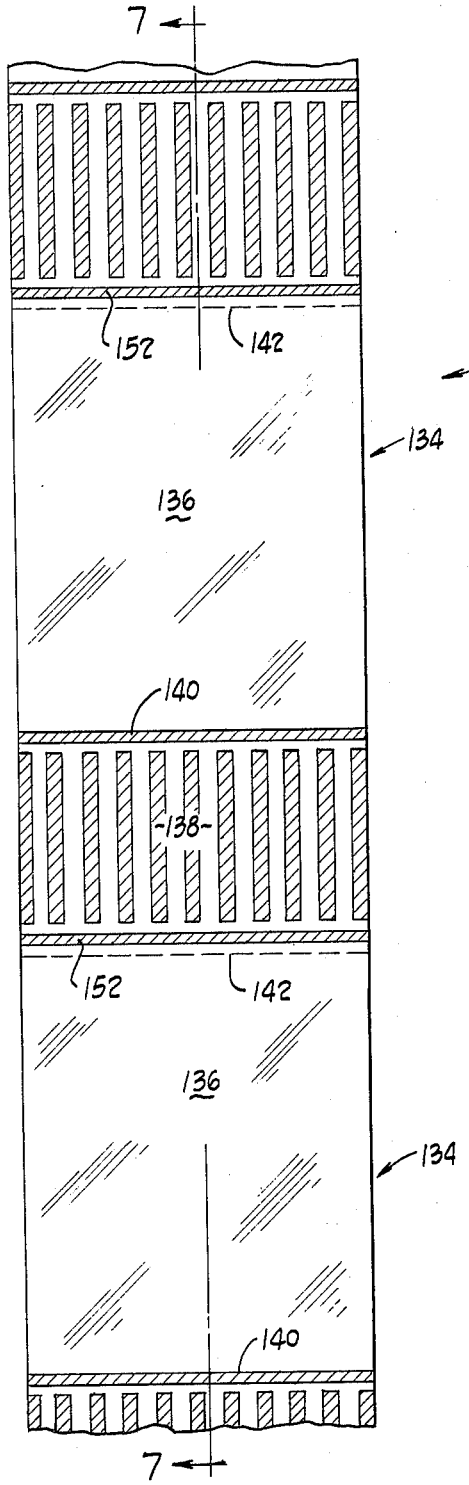
FIGS. 6 and 7 show a container having a header portion produced in accordance with an alternative embodiment of the invention.
Figure 7:
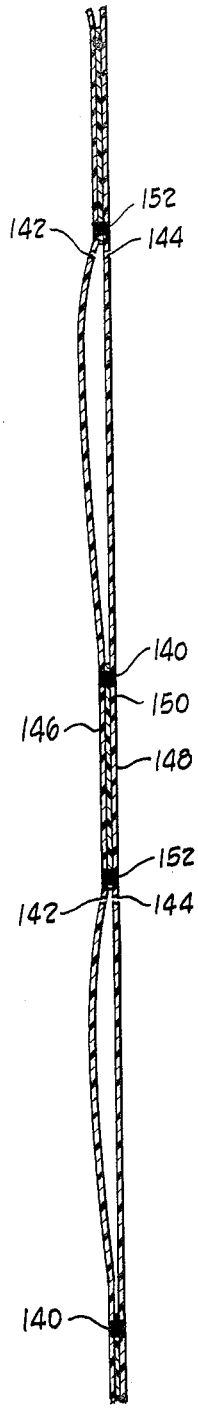

An alternative container strip produced by the process according to the invention is shown in FIGS. 6 and 7. This embodiment is similar to the container shown in FIGS. 5 and 6 of the Container Patent.

A container strip 132 is provided, which container strip includes a plurality of substantially identical containers 134. Each container 134 includes a bag-like portion 136 and a header portion 138. The bag-like portion 136 is constructed substantially identically to the containers 11 and the inserts 26 depicted there can be used with the bag-like portion 136 if desired.

The header 138 is disposed intermediate a heat seal 140 of one container and perforated portions 142, 144 of the succeeding container. Referring more particularly to FIG. 7, the header 138 is comprised of a first web 146, a second web 148, and an insert 150 disposed intermediate the first and second webs 146, 148. The web 146 is extended to form part of the bag-like portion 136. The second web 148 likewise forms part of the bag-like portion 136.

In order to retain the insert 150 firmly in place, a heat seal 152 is provided adjacent the perforated portions 142, 144 and extends completely across the width of the container between and including the sides of the container. In this manner, the insert 150 is secured firmly in place as part of the header 138 and cannot be removed from the header 138. It has been found that if the insert 150 initially is as wide or wider than the superimposed webs 146, 148, and is trimmed and heat sealed when the same operations are performed on the web 146, 148, then the stiffness of the header is increased.

It also has been found that the stiffness of the header 138 is increased remarkably by adhering the insert 150 to either or both of the webs 146, 148. A particularly effective technique is to coat both webs with an adhesive located at spaced intervals, especially in a plurality of narrow strips extending longitudinally of the container. This construction is illustrated in FIGS. 7 and 8. The apparatus illustrated in FIGS. 1 and 2 can be modified with little difficulty to produce these results. Essentially all that is required is to substitute a desired insert material 150 for the paper web 44 and to select appropriate rotational speeds of the rolls 36, 38; 50, 52; and 54 to produce header inserts of the desired spacing and length. If adhesive is to be applied to each web, an additional glue applicator 62 having a plurality of spaced nozzles 63 can be positioned above the cutter roll 54 so that both the upper web and the lower web are sprayed with longitudinally extending strips of glue.

As in the first-mentioned embodiment, the various rolls may be controlled to produce any desired header length, end seal spacing, and perforation spacing. A container constructed according to the invention may be manufactured exceedingly rapidly with little or no adverse affect on production speed from that possible with prior container-making machinery.

Although the invention has been described with a certain degree of particularly, it will be appreciated that the present disclosure of the preferred embodiment has been made only by way of example. Various changes in the details of construction may be resorted to without departing from the true spirit and scope of the invention, and it is intended to cover all such changes in the appended claims.

I claim:

1. A process of making a chain of interconnected bags comprising:

(a) feeding web portions to an inserting station;

(b) feeding inserts sequentially to the insert station;

(c) at the insert station adhering each insert to at least one of the portions after registering each such insert with a cooperating opaque portion on a first of the web portions whereby the inserts are hidden by the opaque portion in a finished chain of bags;

(d) adhering the web portions together to form a tubular structure with the inserts within the structure;

(e) forming a series of longitudinally spaced transversely extending seals to delineate a chain of interconnected containers, each including at least one insert; and (f) forming a transverse line of weakness in each such container to produce a chain of end-to-end connected bags which are each facilely separable from the remainder of the tubular structure and each of which includes at least one of said inserts.

2. A process of making a chain of interconnected bag comprising:

(a) feeding web portions to an inserting station;

(b) feeding inserts sequentially to the insert station;

(c) applying an adhesive to a selected one of the inserts and one of the web portions;

(d) registering each insert with an opaque portion on a first of the web portions whereby the inserts are hidden by opaque portions in the finished chain of bags;

(e) at the insert station adhering each insert to the one portion with the adhesive;

(f) adhering the web portions together to form a tubular structure with the inserts within the structure;

(g) forming a series of longitudinally spaced transversely extending seals to delineate a chain of interconnected containers, each with at least one insert in it.

3. A process of making a chain of interconnected bags comprising:

(a) feeding web portions to an inserting station;

(b) feeding flexible corrosion inhibiting inserts sequentially to the insert station;

(c) applying an adhesive to a selected one of the inserts and one of the web portions;

(d) at the insert station adhering each insert to the one portion with the adhesive;

(e) adhering the web portions together to form a tubular structure with the inserts within the structure;

(f) forming a series of longitudinally spaced transversely extending seals to delineate a chain of interconnected containers, each having a fillable space with at least one insert in each such fillable space; and, (h) forming a transverse line of weakness in each such container to produce a chain of end to end connected bags which are each facilely separable from the remainder of the tubular structure and each of which has at least one of said inserts secured therein.

4. The process of claim 3 including the further step of registering each insert with an opaque portion on a first of the web portions whereby the inserts are hidden by opaque portions in the finished chain of bags.

5. The process of claim 3 wherein each insert is adhered to a web portion near its end which is nearest the top of the fillable portion in which it is placed whereby the inserts will not interfere with the filling of the bag.

* * * * *